US008870168B1

(12) United States Patent
McGuffin

(10) Patent No.: US 8,870,168 B1
(45) Date of Patent: Oct. 28, 2014

(54) BOAT DOCK WITH AERATION SYSTEM

(71) Applicant: Thomas R. McGuffin, Spanish Fort, AL (US)

(72) Inventor: Thomas R. McGuffin, Spanish Fort, AL (US)

( * ) Notice: Subject to any disclaimer, the term of this patent is extended or adjusted under 35 U.S.C. 154(b) by 256 days.

(21) Appl. No.: 13/645,552

(22) Filed: Oct. 5, 2012

(51) Int. Cl.
*B01F 3/04* (2006.01)

(52) U.S. Cl.
USPC ..... 261/124; 261/126; 210/220

(58) Field of Classification Search
USPC ..... 261/121.1, 124, 126, DIG. 42; 210/220
See application file for complete search history.

(56) References Cited

U.S. PATENT DOCUMENTS 3,470,700 A * 10/1969 Rhadigan et al. ..... 405/211
3,488,876 A 1/1970 Lowrance
4,092,943 A * 6/1978 Lund et al. ..... 114/222
4,997,557 A 3/1991 Anderson
5,868,091 A 2/1999 Gross et al.
7,550,079 B2 6/2009 Hughes
7,874,548 B1 1/2011 McGuffin
2003/0001291 A1 1/2003 Stevens
2010/0075400 A1 3/2010 Kania et al.
2011/0042324 A1 2/2011 Hughes

* cited by examiner

*Primary Examiner* — Robert A Hopkins
(74) *Attorney, Agent, or Firm* — George L Williamson

(57) ABSTRACT

Method and apparatus discloses a dock having a floatatable aeration system incorporated therein. The dock may be a floating or a fixed pier system having a walkway for users to move about the dock, a plurality of boat berthing slips which may be designed to accommodate one or more boats in each slip, along with individual finger-like docks disposed between each boat berthing area. Incorporated at various locations in the dock is an aeration system that includes aerators having a single or double concaved surface at the top of a fluid intake chamber for diverting aerated fluid away from the enclosure of the aerator.

11 Claims, 3 Drawing Sheets

BOAT DOCK WITH AERATION SYSTEM

BACKGROUND OF THE INVENTION

1. Field of the Invention

The present invention relates generally to boat docks and, more particularly, is concerned with a boat dock having an aeration system incorporated therein.

2. Description of the Related Art

Aeration systems related to boat docks have been described in the related art, however, none of the related art devices disclose the unique features of the present invention.

In U.S. Patent Application Publication No. 2003/0001291 dated Jan. 2, 2003, Stevens disclosed an apparatus and method for preventing growth of marine organisms. In U.S. Patent Application Publication No. 2010/0075400 dated Mar. 25, 2010, Kania, et al., disclosed a low-cost microbial habitat from water quality enhancement and wave mitigation. In U.S. Pat. No. 7,550,079 dated Jun. 23, 2009, Hughes disclosed a system and method for water restoration. In U.S. Pat. No. 3,488,876 dated Jan. 13, 1970, Lowrance disclosed a method and apparatus for improving fishing under a fishing dock. In U.S. Pat. No. 5,868,091 dated Feb. 9, 1999, Gross, et al., disclosed a float mounted aerator having a work deck. In U.S. Pat. No. 4,997,557 dated Mar. 5, 1991, Anderson disclosed a floating, mixing, aerating and decanting method. In U.S. Patent Application Publication No. 2011/0042324 dated Feb. 24, 2011, Hughes disclosed a system and method for water restoration. In U.S. Pat. No. 7,874,548 dated Jan. 25, 2011, McGuffin, the inventor of the present invention, disclosed a floatatable aerator system.

While these devices may be suitable for the purposes for which they were designed, they would not be as suitable for the purposes of the present invention as hereinafter described.

SUMMARY OF THE PRESENT INVENTION

The present invention discloses a dock having an aeration system incorporated therein. The dock may be a floating or a fixed pier system having a walkway or deck for users to move about the dock, a plurality of boat berthing slips which may be designed to accommodate one or more boats in each slip, along with individual finger-like docks disposed between each boat berthing area. Also incorporated therein may be a gangway with handrails for attaching the dock to a more permanent or land based structure. Incorporated at various locations in the dock is an aeration system that includes aerators having a concaved surface at the top of a fluid intake chamber for diverting aerated fluid away from the enclosure of the aerator. The aerators of the dock have a water intake and a water outlet which may have a single discharge or double, oppositely disposed discharge having a plurality of aerating tubular members which are used to move or pump the water through the aerator and also to aerate the water as it is pumped through the aerator.

The aerators of the present invention are described in U.S. Pat. No. 7,874,548 dated Jan. 25, 2011 to McGuffin, the inventor of the present invention. U.S. Pat. No. 7,874,548, in a broad sense, discloses a method and apparatus for a floatatable aerator system comprising a hollow chamber supported by floats, the chamber having a concaved rear surface, a fluid intake chamber having a fluid inlet and a top aerated fluid diverter created by the concaved rear surface; a fluid aerator assembly for injecting air into fluid received through the fluid inlet to form aerated fluid; and, a bank of lateral outlet ports for expelling the diverted aerated fluid funneled along the concaved rear surface.

An object of the present invention is to provide an aerator disposed on a dock wherein the dock may be a fixed or floating dock. A further object of the present invention is to aerate the water under and around the dock. A further object of the present invention is to provide a dock which can be used to berth boats. A further object of the present invention is to aerate the water around the dock so as to improve the quality of the water in and about the dock. A further object of the present invention is to provide an aerated dock which can be easily used by an operator. A further object of the present invention is to provide an aerated dock which can be relatively easily and inexpensively manufactured.

The following detailed description is, therefore, not to be taken in a limiting sense, and the scope of the present invention is best defined by the appended claims.

BRIEF DESCRIPTION OF THE DRAWINGS

In order that the invention may be more fully understood, it will now be described, by way of example, with reference to the accompanying drawings in which.

LIST OF REFERENCE NUMERALS

Figure 1:
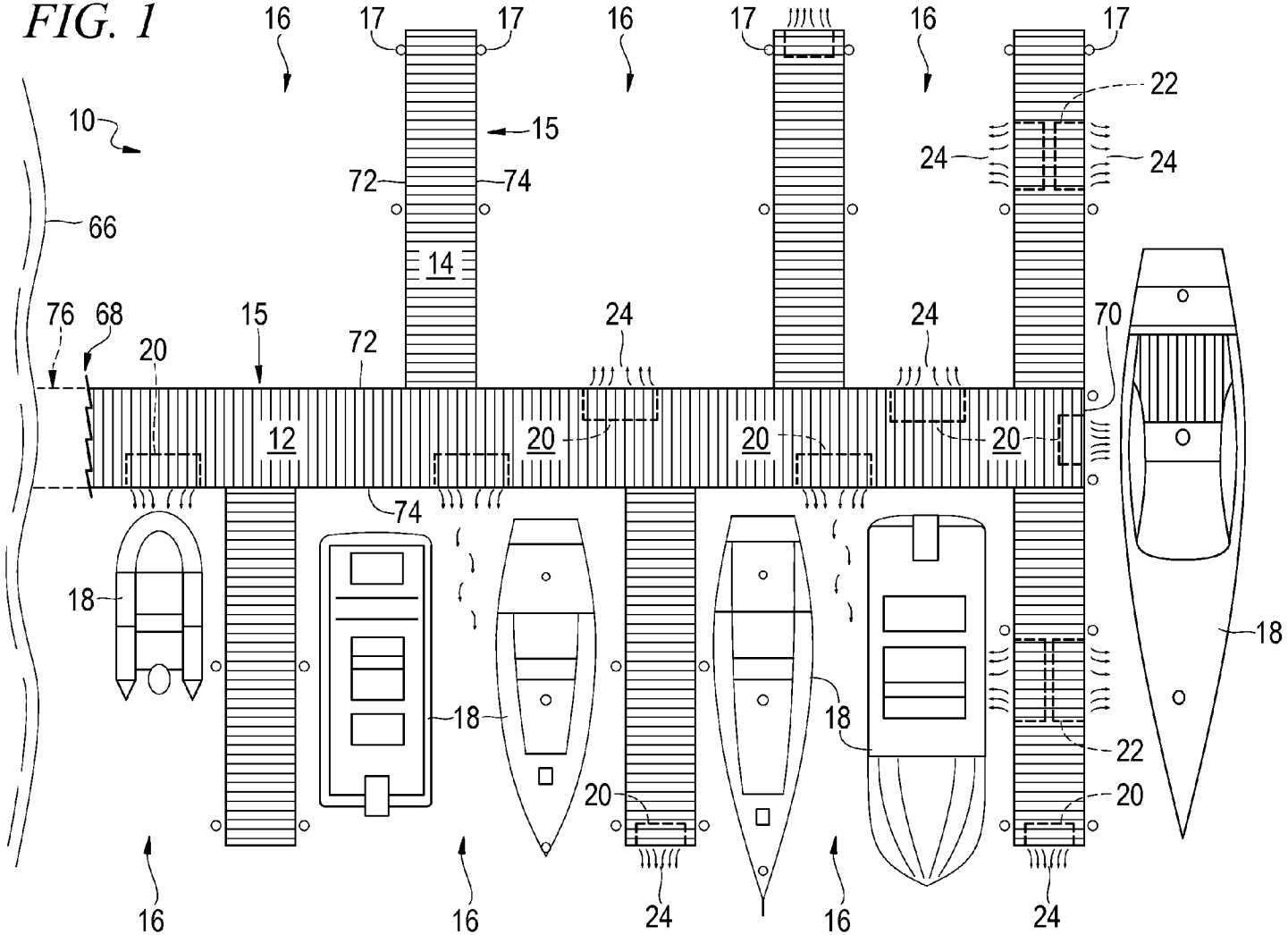
FIG. 1 is a plan view of a first embodiment of the present invention.

With regard to reference numerals used, the following numbering is used throughout the drawings.

10 present invention
12 main walkway of dock
14 finger walkway of dock
15 dock
16 berthing slip for vessel
17 pile
18 vessel
20 aerator with single discharge
22 aerator with double discharge
24 discharge stream/direction arrows
26 floating dock
28 float
30 inlet water/fluid
32 inlet
34 outlet/discharge
35 water surface
36 chassis
38 aeration system
40 fluid
42 aeration diffuser
44 hollow chamber
46*a* top wall
46*b* front wall
46*c* concaved back wall
46*d* bottom wall
48*a* end baffle wall
48*b* end baffle wall
48*c* interior baffle wall
48*d* interior baffle wall
50 fluid uptake chamber
52 arrow designating discharge water

54 air inlet port
56 outlet/discharge
58 central hollow chamber
60 concave wall
62 baffle wall
64 bottom
66 shore
68 first end portion
70 second end portion
72 first side
74 second side
76 gangway
78 upper surface
80 lower surface
82 cavity
84 cover
86 angle iron member
88 fastener
90 water body
92 conduit(s)

DETAILED DESCRIPTION OF THE PREFERRED EMBODIMENT

The following discussion describes in detail at least one embodiment of the present invention. This discussion should not be construed, however, as limiting the present invention to the particular embodiments described herein since practitioners skilled in the art will recognize numerous other embodiments as well. For a definition of the complete scope of the invention the reader is directed to the appended claims. FIGS. 1 through 5 illustrate the present invention wherein an aeration system for a dock is disclosed which system is generally indicated by reference number 10.

There is a great concern by everyone about pollution of our waterways, especially, sources of our drinking water. A major source of pollution in our drinking water reservoirs are marinas. Marinas are sometimes referred to as a Point of Pollution (POP). The Clean Water Act attempts to address this issue but has not identified a solution.

The present invention discloses a potential solution for the problem. The present invention discloses an aerator system built into a floating or fixed dock which are a major source of pollution at marinas. A major water quality issue at marinas is low dissolved oxygen and a major benefit of the present invention is that the aerators help increase the level of dissolved oxygen. Also, another advantage of the present invention is that the aerator units are expected to be out of sight and will not impede boat traffic. It is believed that the Coast Guard will spend several million dollars on floating dock systems next year and millions more every year for repairs. There are an estimated 97,000 permitted marinas in the U.S. so the potential problems are enormous.

Turning to FIG. 1, therein is shown an exemplary layout of the present invention 10 having a dock generally designated by reference number 15. Each dock 15 may have a major walkway or deck portion 12 on the dock, upon which users can walk, and may also have a plurality of finger walkway portions 14 along with a plurality of vessel or boat berthing slips 16 and also having a plurality of vessels 18 being docked or moored at the dock. Each dock 15 is expected to have a first end portion 68 and a second end portion 70 along with oppositely disposed first 68 and second 70 side portions so that the walkways 12, 14 are disposed thereinbetween the side portions. It is expected that a connecting portion or gangway 76 (shown in phantom line), or the like, will also be provided for securing the dock 15 to the shore 66. Also shown are a plurality of aerators wherein the aerators may have a single discharge 20 or aerators may have a double discharge 22, each showing the discharge stream 24 by using direction arrows to indicate the flow of water. The present invention 10 can thus incorporate a plurality of aerators 20, 22 into the dock 15 which aerators may have a single or one-sided discharge or flow, or, a double-sided discharge or flow. The aerators 20, 22 can be adapted to any of the virtually limitless patterns of floating dock systems which already exist or may be built in the future. The aerators 20, 22 may be located at any point of the dock including along the fingers 14, at the ends of the fingers, along the main walkway 12, or at the head of the boat berthing slip 18. A plurality of spaced apart piles 17, which may be mooring piles, are shown for providing structural support between the dock and the bottom 64 (not shown see FIG. 2) of the water body for the exemplary dock 15 shown in FIG. 1 which dock is affixed to the bottom of the water body.

Figure 2:
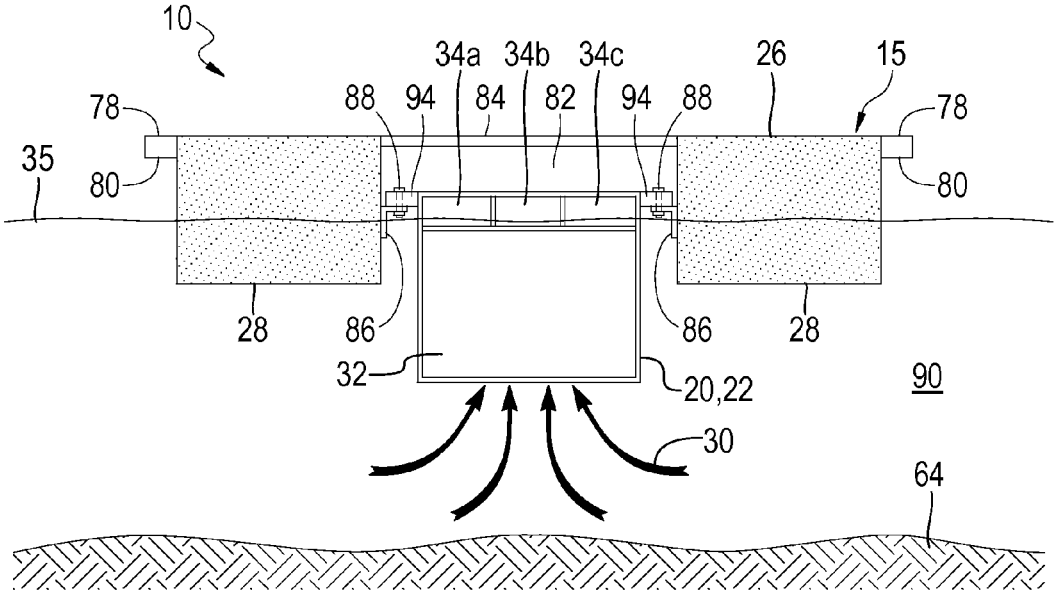
FIG. 2 is a cross-sectional view of a second embodiment of the present invention.

Turning to FIG. 2, therein is shown an exemplary portion of a floating dock 26 of the present invention 10 showing the dock 26 along with the floats 28 for the dock and an exemplary aerator 20 or 22 having a generally upwardly inlet flow shown by direction arrows 30 into the intake 32 of the aerator along with an outlet, divided into outlet ports 34*a*, 34*b*, 34*c*, on the aerator which creates a circular flow pattern from the bottom portion to the upper portion of the water body 90. Since the water with the lower dissolved oxygen and other pollutants is generally nearer the bottom, this circular water flow pattern is generally beneficial to the water quality of the water body 90. Also shown is the water surface 35 of the water body 90. Floats 28 may be made of any suitable material and may be in the form of buoys or buoyant material. Also shown is the dock 15, a walkway which could be either 12 or 14 as earlier disclosed, upper surface 78, upon which users walk, and lower surface 80. Also shown is a cavity or space 82 underneath the walkway 12, 14 for housing the aerator 20, 22 wherein the cavity is covered by a removable access cover or hatch 84 so the aerators can be accessed or removed for servicing when the cover/hatch is removed. The aerators 20, 22 could be mounted to the dock 15 in numerous ways, however for illustration purposes only, the aerators are shown mounted to angle iron members 86, which angle iron members are disposed around the inner surface of the cavity 82, using a plurality of fasteners 88, e.g., nuts and bolts, which attach to a flange member 94 disposed around the upper edge of the aerator chassis 36 so that the aerators are removably, fixedly attached to the dock 15.

The present invention 10, as shown in FIGS. 1 and 2, including the dock 15, piles 17, aerators 20, 22, floats 28 and related appurtenances, may be constructed of any suitable material as would be done in the standard manner by one skilled in the art. Furthermore, the dock 15 may be equipped with lights, mooring cleats, benches and/or fish cleaning tables, and other appurtenances as would be done in the standard manner by one skilled in the art.

The aerators 20, 22 are described and disclosed in U.S. Pat. No. 7,874,548, dated Jan. 25, 2011, to Thomas R. McGuffin, the inventor of the present invention. However, it is expected that it would be possible to incorporate other types of aerators into the design and embodiments of the present invention.

Figure 3:
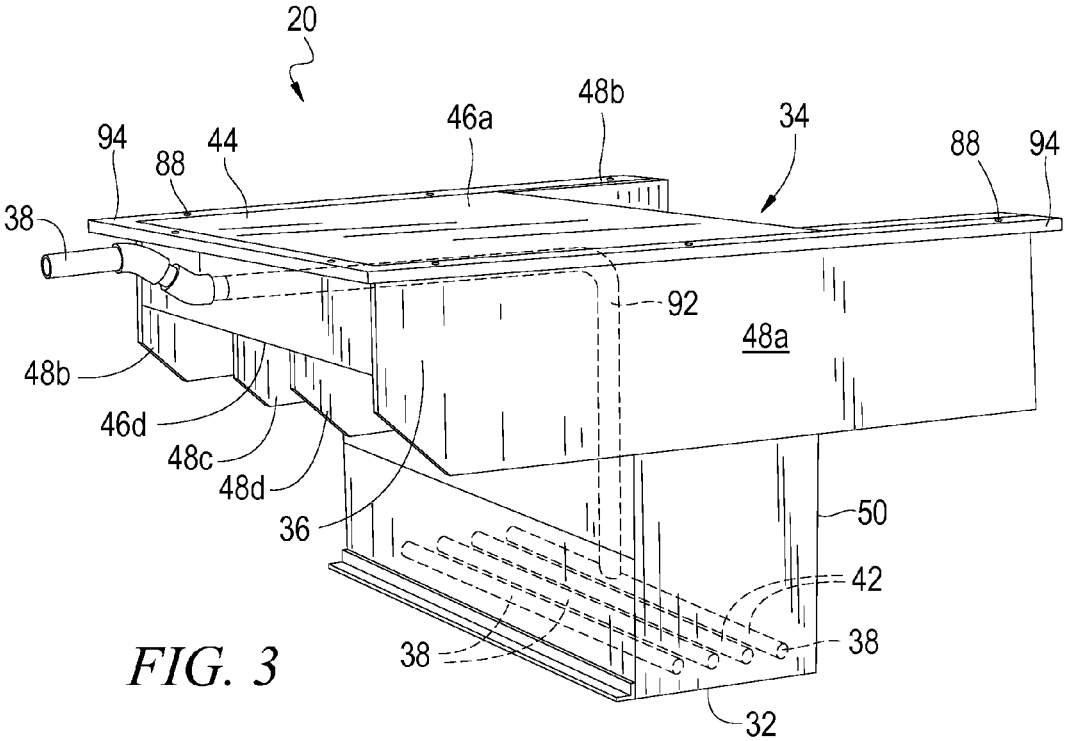
FIG. 3 is a perspective view of a first embodiment of an aerator of the present invention.
Figure 4:
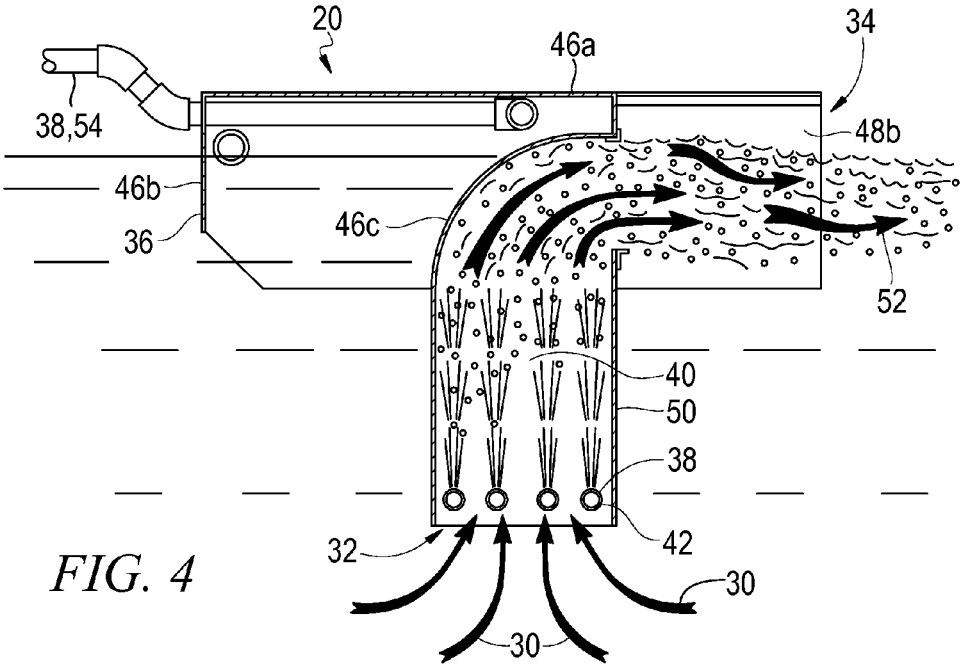
FIG. 4 is a cross sectional view of a first embodiment of an aerator of the present invention.

Turning to FIGS. 3 and 4, therein is disclosed an aerator 20 having a single inlet or uptake 32 and a single discharge 34 which aerator is comprised of a floatatable chassis-like enclosure 36 having an aerating system 38 coupled thereto, the aerating system 38 aerating fluid 40 flowing through the aerator chassis 36. Also shown are the air diffusers or outlets 42. The floatatable chassis 36 increases the buoyancy of the dock 15 of the present invention 10 provided by other conventional floats 28.

The floatable aerator chassis 36 has a side profile that resembles a "T"-shape (see FIG. 3) and a top view that resembles a "U"-shape (see FIG. 3). The flotatable aerator chassis 36, which has its own floatatable characteristics independently of the float(s) 28 of the dock, comprises an upper hollow chamber 44 bounded by a top wall 46*a*, front wall 46*b*, a concaved back wall 46*c*, and a bottom wall 46*d*. The hollow chamber 44 is supported by a plurality of baffle walls 48*a*, 48*b*, 48*c* and 48*d*. The two end baffle walls 48*a*, 48*b* serve as side walls for the hollow chamber 44 and extend past both the length and depth of the hollow chamber 44. The interior baffle walls 48*c*, 48*d* extend the length of the hollow chamber 44. Additional means for flotation (not shown), in the form of air cavities or flotation material, is disposed on the inside of the chassis 36.

The aerator chassis 36 further includes a fluid uptake chamber 50 having a fluid intake port or inlet 32 for intaking fluid 30 from beneath the chassis and a discharge port or outlet 34 located between baffle walls 48*a*, 48*b*. The opening of the fluid uptake chamber 50 is displaced approximately 90 degrees with respect to the openings of the discharge 34 which is further divided into apertures or ports 34*a*, 34*b*, 34*c* (see FIG. 2).

The discharge port 34*a*, 34*b*, 34*c* shares the concaved back wall 46*c* of the hollow chamber 44 to funnel or divert water behind the hollow chamber 44 between the two end baffle walls 48*a*, 48*b*. The concaved back wall 46*c* provides approximately a 90 degree elbow for the flow of aerated water in the uptake chamber 50 directly to the bank of discharge ports 34*a*, 34*b*, 34*c* as best seen in FIG. 4. Arrow 52 in FIG. 4 shows the water discharge. As can be readily seen the extended end baffle walls 48*a*, 48*b* create a semi-enclosed area or pool wherein aerated water collects thereinbetween.

The aerator system 38 comprises an air inlet port or conduit 54 coupled to the front wall 46*b* or other suitable portion of hollow chamber 44. The inlet port 54 is adapted to be coupled to a flexible hose (not shown) which is coupled to an air or other oxygen source (not shown) as would be done in the standard manner by one skilled in the art. The air inlet conduit 54 conveys air through a series of conduit(s) 92 down to the plurality of air diffusers 42 inside and near the lower end of fluid uptake chamber 50 forming air jets which force air directly in the path of fluid 30 so that the rising air bubbles create a forceful pattern of fluid flow from beneath the chassis 36 upwardly and out the discharge apertures or ports 34*a*, 34*b*, 34*c*.

The aerating system 38 receives fluid or water 30 up through the inlet port 32 (as shown by arrows 30 on FIG. 4) where the fluid is subjected to air jet streams from a plurality of air diffusers 42. The fluid or water 30 is thus aerated and forced upward through the chassis 36 where the fluid diverter in the form of concaved back wall 46*c* funnels or diverts the aerated fluid out through discharge port 34*a*, 34*b*, 34*c*. In one embodiment, the uptake chamber 50 is approximately in the center of the length of the two end baffle walls 48*a*, 48*b*. The flotatable aerator 20 in conjunction with floats 28 suspend the dock 12, 14 and aerator(s) 20 in the water so that an upper portion of the hollow chamber 44 remains above water and, preferably, the inlet port 32 remains above the subterranean earth disposed on the bottom 64 (see FIG. 2) of a pond, reservoir, bay, river or like water body.

By way of general explanation, the aerators 20, 22 require an anchoring system for attachment to the dock 15 of the present invention 10 as would be done in the standard manner by one skilled in the art so as to maintain their position on the surface of the water, otherwise they could move in the water. Suitable mounting means could include brackets, flanges and/or straps, or the like. The floating capability of aerator 20, 22 may be due to lightweight floatatable PVC, top hollow chamber, or other similar flotation devices. As shown in FIG. 2, the aerators 20, 22 could be mounted to the dock 15 using angle iron members 86, which angle iron members are disposed around the inner surface of the cavity 82, using a plurality of fasteners 88, e.g., nuts and bolts, which attach to a flange member 94 disposed around the upper edge of the aerator chassis 36 so that the aerators are removably, fixedly attached to the dock 15.

Figure 5:
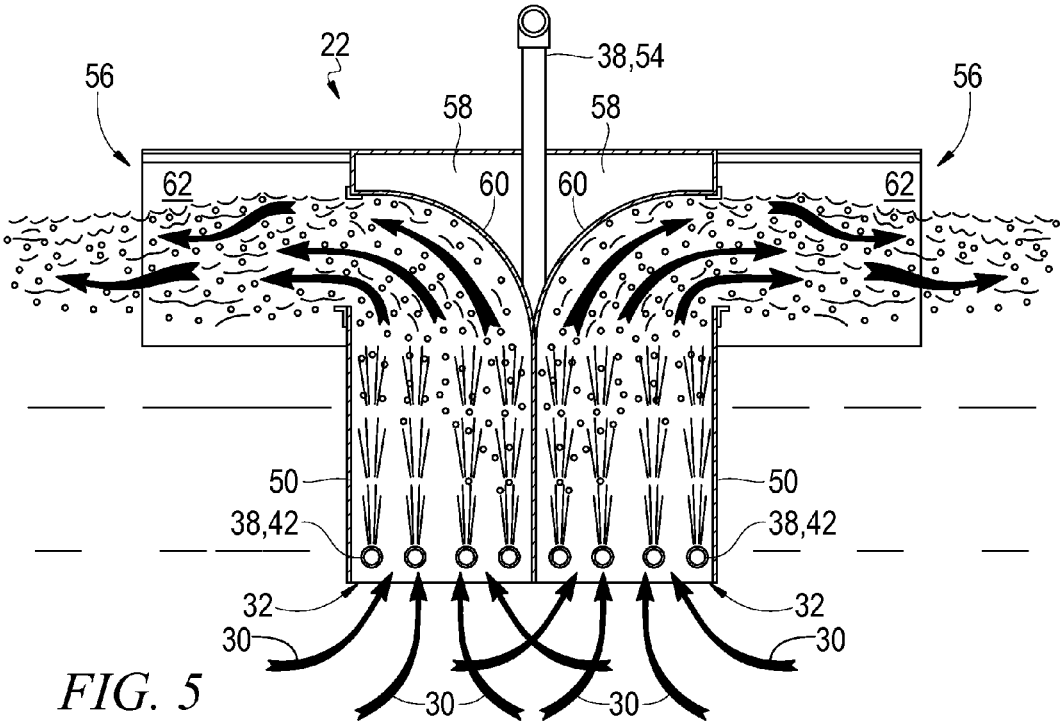
FIG. 5 is a cross sectional view of a second embodiment of an aerator of the present invention.

Turning to FIG. 5, therein is shown an alternative embodiment for an aerator 22 of the present invention 10 having oppositely disposed or directed double water discharges 56, however, in most other respects this embodiment is similar to the previous embodiment of aerator 20. Also shown are centrally disposed hollow chamber 58, fluid 30, two concaved walls 60, two baffle walls 62, two inlet ports 32, two fluid uptake chambers 50, two aerating systems 38 and multiple sets of air diffusers 42.

By way of summary, and with reference to FIGS. 1-5, the present invention 10 aerates a body of water 90 surrounding a boat dock 15, and comprises: a dock 15 disposed on the body of water 900; at least one aerator 20, 22 disposed on the dock to permit the water of body to be aerated; the aerator further comprising a chassis 36; a water uptake chamber 50 having a water inlet 32 at a bottom portion of the chassis, a water diverter 46*c* disposed at an upper portion of the chassis, the diverter having a concaved surface to permit aerated water to be diverted therefrom; a water aerator assembly 38 for injecting air into the water 30 received through the water inlet to form aerated water 52, and, at least one lateral outlet port 34 for expelling the diverted aerated water away from the dock; furthermore, the chassis having a hollow chamber 44, the hollow chamber having a top wall 46*a*, a front wall 46*b*, and a pair of end baffle walls 48*a*, 48*b* on opposite sides of the top wall, the end baffle walls extending beyond a rear end of the top wall, downwardly extending fluid uptake chamber 50 having a fluid inlet port 32 at a bottom thereof located between front and rear ends of the end baffle walls, and extending a full width of the hollow chamber between the end baffle walls; a plurality of spaced elongated tubular members 42 located within the fluid uptake chamber adjacent the fluid inlet port and extending the full width of the fluid uptake chamber, each tubular member having spaced apart apertures 42 for injecting air into said fluid; means for supplying air to the tubular members for aerating the fluid; and, a concaved back wall of the hollow chamber located at an upper end of the fluid uptake chamber for directing flowing fluid back directly into the reservoir or pond, the flowing fluid being directed into a semi-enclosed pool formed between the end baffle walls extending beyond the rear end of the top wall; furthermore, it comprises a plurality of parallel baffle walls 48*c*, 48*d* under the top wall between the end baffle walls extending from the front wall to the concaved back; further, a side view of the apparatus resembles a T-shape (see FIG. 4, 5); and a top view of the apparatus resembles a U-shape (see FIG. 3); furthermore, as shown in FIG. 5, the hollow chamber has a first and second fluid uptake chamber having a first and second fluid inlet and a top aerated fluid diverter having a first and second concaved back wall; a first and second fluid aerator assembly for injecting air into the fluid received through said first and second fluid inlet to form aerated fluid; and, first and second oppositely disposed lateral outlet ports for expelling the diverted aerated fluid.

I claim:

1. An apparatus for aerating a body of water surrounding a boat dock, comprising:

a) a dock disposed on the body of water;

b) at least one aerator disposed on said dock to permit the water of body to be aerated;

c) said aerator further comprising a chassis;

d) a water uptake chamber having a water inlet at a bottom portion of said chassis, a water diverter disposed at an upper portion of said chassis, said diverter having a concaved surface to permit aerated water to be diverted therefrom;

e) a water aerator assembly for injecting air into the water received through said water inlet to form aerated water, and, f) at least one lateral outlet port for expelling the diverted aerated water away from said dock.

2. The apparatus of claim 1, further comprising:

a) said chassis having a hollow chamber for flotation, said hollow chamber having a top wall, a front wall, and a pair of end baffle walls on opposite sides of said top wall, said end baffle walls extending beyond a rear end of said top wall;

b) a downwardly extending fluid uptake chamber having a fluid inlet port at a bottom thereof located between front and rear ends of said end baffle walls, and extending a full width of said hollow chamber between said end baffle walls;

c) a plurality of spaced elongated tubular members located within said fluid uptake chamber adjacent said fluid inlet port and extending the full width of said fluid uptake chamber, each said tubular member having spaced apart apertures for injecting air into said fluid;

d) means for supplying air to said tubular members for aerating said fluid; and, e) a concaved back wall of said hollow chamber located at an upper end of said fluid uptake chamber for directing flowing fluid back directly into said reservoir or pond, said flowing fluid being directed into a semi-enclosed pool formed between said end baffle walls extending beyond said rear end of said top wall.

3. The apparatus of claim 2, further comprising a plurality of parallel baffle walls under said top wall between said end baffle walls extending from said front wall to said concaved back.

4. The apparatus of claim 3, wherein a side view of the apparatus resembles a T-shape; and a top view of the apparatus resembles a U-shape.

5. The apparatus of claim 2, further comprising:

a) said hollow chamber having a first and second fluid uptake chamber having a first and second fluid inlet and a top aerated fluid diverter having a first and second concaved back wall;

b) a first and second fluid aerator assembly for injecting air into the fluid received through said first and second fluid inlet to form aerated fluid; and, c) first and second oppositely disposed lateral outlet ports for expelling the diverted aerated fluid.

6. A method for aerating a body of water surrounding a boat dock, comprising:

a) providing a dock disposed on the body of water;

b) aerating the body of water surrounding the dock using at least one aerator disposed on the dock;

c) providing a water uptake chamber having a water inlet at a bottom of the aerator for receiving water from underneath the dock, providing a water diverter near an upper portion of the aerator, the water diverter having a concaved surface for diverting water away from the dock;

d) injecting air into the water received through the water inlet to form aerated water, and, e) providing at least one lateral outlet port for expelling the diverted aerated water away from the dock.

7. The method of claim 6, further comprising the steps of:

a) providing a hollow chamber on the chassis for flotation, the hollow chamber having a concaved rear surface;

b) providing a fluid uptake chamber having a fluid inlet port and a top aerated fluid diverter created by the concaved rear surface;

c) providing a fluid aerator assembly for injecting air into the fluid received through the fluid inlet port to form aerated fluid; and, d) providing a bank of lateral outlet ports for expelling the diverted aerated fluid funneled along the concaved rear surface back directly into the reservoir or pond in a semi-enclosed pool formed by end baffle walls forming side walls of said chamber, the end baffle walls extending beyond the concaved rear surface and a top wall of said chamber.

8. The method of claim 7, wherein the fluid aerator assembly comprises spaced-apart, elongated tubular members, wherein each elongated tubular member has a plurality of spaced-apart apertures to form air jets.

9. The method of claim 8, further comprising the steps of providing a plurality of interior parallel baffle walls in the hollow chamber, wherein the interior baffle walls extend from the front wall to the concaved rear surface of the hollow chamber.

10. The method of claim 9, wherein a side view resembles a T-shape and a top view resembles a U-shape.

11. The method of claim 7, further comprising the steps of:

a) providing a hollow chamber having a first and second fluid uptake chamber having a first and second fluid inlet and a top aerated fluid diverter having a first and second concaved back wall;

b) providing first and second fluid aerator assembly for injecting air into the fluid received through the first and second fluid inlet to form aerated fluid; and, c) providing first and second oppositely disposed lateral outlet ports for expelling the diverted aerated fluid.

* * * * *